US006390005B1

(12) United States Patent
Chia et al.

(10) Patent No.: US 6,390,005 B1
(45) Date of Patent: May 21, 2002

(54) METHOD OF FILLING AN EMBROIDERY STITCH PATTERN WITH SATIN STITCHES HAVING A CONSTANT INTERSTITCH SPACING

(76) Inventors: Benito Chia, 150 FB Cabahug St., Mandaue City, Cebu (PH); Brian Goldberg, 73 Coldwater Court, Thornhill, Ontario (CA), L4J 7S4; Niranjan Mayya, 7080 Walworth Court, Mississauga, Ontario (CA), L5N 7L4; Anastasios Tsonis, 185 Golf Court Rd, Conemoga, Ontario (CA), N0B 1N0

( * ) Notice: Subject to any disclaimer, the term of this patent is extended or adjusted under 35 U.S.C. 154(b) by 0 days.

(21) Appl. No.: 09/079,011

(22) Filed: May 14, 1998

(51) Int. Cl.[7] ..... D05B 97/00
(52) U.S. Cl. ..... 112/475.19
(58) Field of Search ..... 112/475.19, 475.18, 112/475.21, 102.5, 470.06, 453, 456, 457

(56) References Cited

U.S. PATENT DOCUMENTS 5,560,306 A * 10/1996 Kyuno ..... 112/102.5
6,247,420 B1 * 6/2001 Chan et al. ..... 112/475.19

* cited by examiner

*Primary Examiner*—Peter Nerbun
(74) *Attorney, Agent, or Firm*—Lawrence G. Kurland, Esq.; Bryan Cave LLP

(57) ABSTRACT

A method of filling a defined embroidery pattern shape, with the shape comprising a curve defining the shape, fills the pattern shape with a plurality of turning satin-like embroidery stitches which turn to follow the defined shape. In carrying out the method, the density inset for the next adjacent satin-like embroidery stitch is dynamically varied in accordance with any change in the defined shape from the previous stitch, taking into account the stitch length and stitch angle. The process is iteratively repeated , using the predefined perpendicular distance from the previous stitch end point to the new stitch end point until the defined shape is completely filled.

24 Claims, 7 Drawing Sheets

FIG. 13
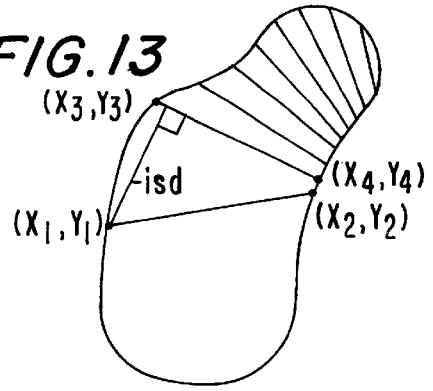
FIG. 14
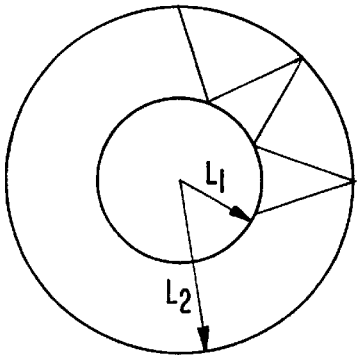
FIG. 15
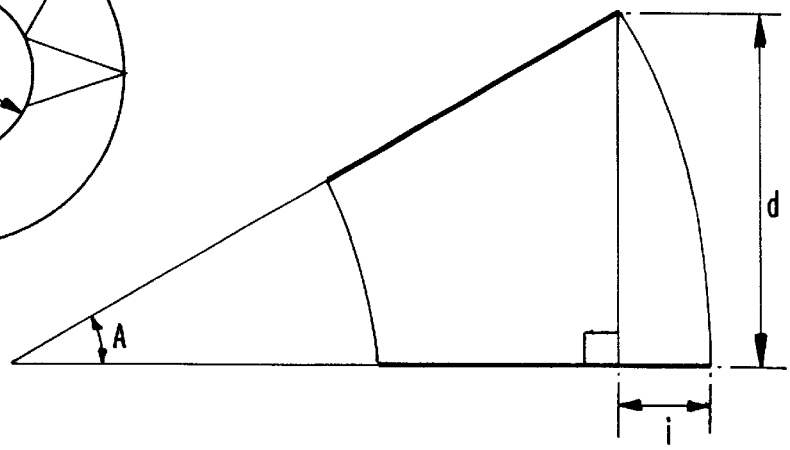
FIG. 16
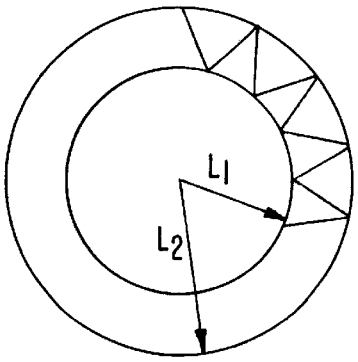
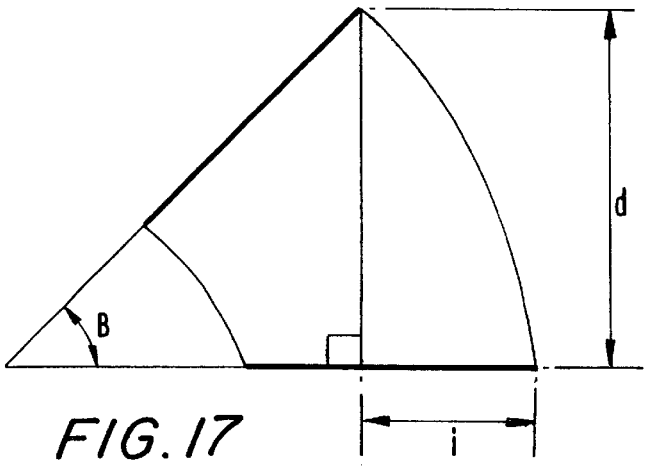
FIG. 17

FIG. 18
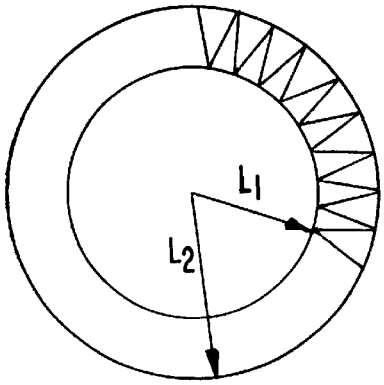
FIG. 19
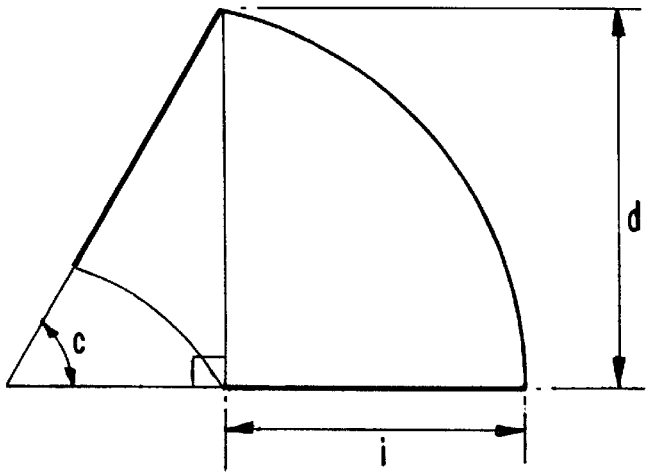
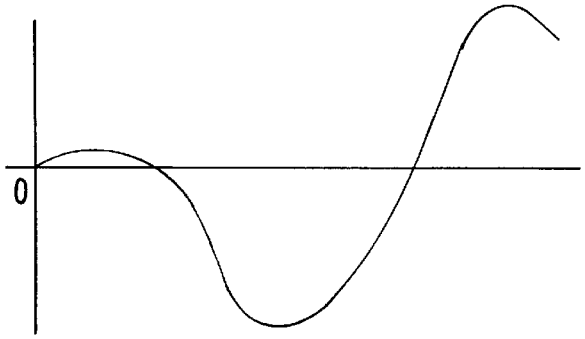
x WITH RESPECT TO t
FIG. 20
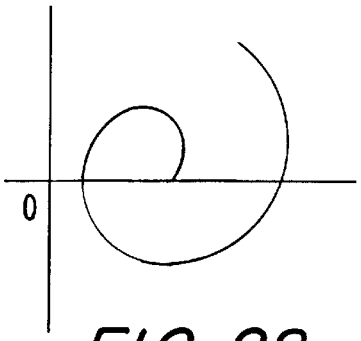
FIG. 22
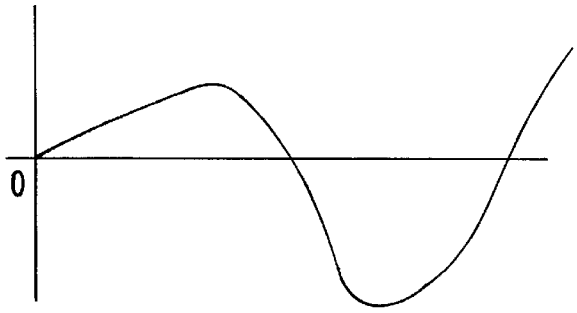
y WITH RESPECT TO t
FIG. 21

METHOD OF FILLING AN EMBROIDERY STITCH PATTERN WITH SATIN STITCHES HAVING A CONSTANT INTERSTITCH SPACING

BACKGROUND OF THE INVENTION

1. Field of the Invention

The present invention relates to methods for filling defined embroidery patterns with satin-like embroidery stitches, and more particularly to such methods in which a predefined interstitch spacing between adjacent turning stitches, which may be a constant, is maintained as the pattern is filled regardless of any variation in curvature of the pattern shape.

2. Description of the Related Art

The satin stitch and its many variations, such as tatami stitches, is a well known technique in embroidery for filling shapes, such as shown by way of example in U.S. Pat. No. 5,592,891 or the commonly owned copending U.S. paten application Ser. No. 08/794,010, filed Feb. 3, 1997, U.S. Pat. No. 5,809,921 and entitled "Method For Generating a Continuously Stitched Regional Carved Fill Composite Embroidery Stitch Pattern". This class of stitch is generally characterized by lines of stitching which run in alternate directions and can be used to fill defined embroidery pattern shapes, such as illustrated in FIGS. 1 and 2, respectively, with parallel lines of stitching (FIG. 1) or lines of stitching which turn to follow the defined shape (FIG. 2). In filling such patterns, there is a desire to try to maintain a predefined stitch density and interstitch spacing, which may be a constant, throughout the entire filled pattern; however, prior art attempts at doing this where the pattern to be filled has a curved shape have not been satisfactory, particularly where there are numerous variations in curvature of the pattern shape.

Stitch density is normally determined by the distance between adjacent stitches or by the number of stitches per inch. In either case, a determination must be made as to where this distance is to be determined, such as at the end points of the stitch or at some distance in from the end point of the stitch. When the pattern shape to be filled is rectilinear or parallel stitches are being employed to fill the pattern shape, there is no real difference. However, this is not so when the stitches turn to follow a curving pattern shape, such as illustrated in FIG. 2. When the stitches turn, determining this distance at the end points of the stitch produces more stitches then if it is determined at a set distance in from the end points of the stitch. In the prior art, this determination has varied depending on the desired results and some have determined the density at the end points of the stitch while others have fixed it at a point 25% or 33% in from the end point of the stitch. The advantage to setting this determination at the end points of the stitch is that the stitch density is more consistent in wide turning satin stitch or tatami stitch columns, while the disadvantage is that more short stitching is required in order to maintain even stitch coverage in the inside of the turn. The problems in the prior art in producing a satisfactory filled pattern were magnified by unsatisfactory prior art attempts to generate stitches at a predefined, such as a constant, desired interstitch spacing or distance throughout the pattern as the pattern and the stitches turn. Three examples of such unsatisfactory prior art solutions to this problem are illustrated in FIGS. 3 through 8. FIGS. 3 and 4 illustrate an unsatisfactory prior art approach in which the outside end points of the stitches are placed at a specified interstitch distance, or isd, apart. As illustrated in FIGS. 3 and 4, this approach results in placing insufficient space between the stitches when the pattern shape being filled is locally sloped relative to the stitches. FIGS. 5 and 6 illustrate another unsatisfactory prior art approach in which a point r is first constructed that is a specified distance away from the outside end point of the previous stitch along a vector that is perpendicular to the previous stitch, and then the actual stitch that passes through this point, but lies inside the shape being filled, is then created. As illustrated in FIGS. 5 and 6, this prior art approach places insufficient spacing between turning stitches when the stitches are turning to follow the curving pattern shape, with this problem worsening the more tightly the stitches turn. Finally, FIGS. 7 and 8 illustrate still another unsatisfactory prior art approach, which is really an enhancement to the unsatisfactory method described with respect to FIGS. 5 and 6. In this prior art approach, an inset percentage is specified which controls the starting point for the creation of the point r employed in the prior method. The basic intent is that this point r be as close to the edge of the pattern shape as possible. This prior art method assumes that the user will specify an appropriate inset, with the appropriate value of the inset being determined by the amount of curvature of the pattern shape. This prior art method, like the other prior art methods discussed above, assumes that a single fixed inset is appropriate for the entire pattern shape. However, pattern shapes may normally exhibit a wide range of curvature and, accordingly, this method results in some spots having insufficient spacing and other spots having too much spacing between stitches as the curvature of the pattern varies, such as illustrated in FIGS. 7 and 8. These disadvantages of the prior art are overcome by the present invention which provides for a constant interstitch spacing regardless of variations in the curvature of the pattern shape being filled.

SUMMARY OF THE INVENTION

A method of filling a defined embroidery pattern shape comprising a curve defining the shape, which is filled with a plurality of turning satin-like embroidery stitches which turn to follow the defined shape, maintains a predefined interstitch spacing, such as a constant, between adjacent turning satin-like embroidery stitches as the defined shape is filled with the satin-like embroidery stitches. In carrying out the method, the density inset for the next adjacent satin-like embroidery stitch is dynamically varied in accordance with any change in the defined shape from the previous stitch, taking into account the stitch length and stitch angle. The associated end points of the next stitch are brought within an appropriate density inset distance from the previous adjacent stitch for maintaining the predefined interstitch spacing by creating an initial stitch having an associated end point along the curve defining the pattern shape and then creating a next stitch having an associated end point along the curve which is a perpendicular distance from the previous stitch end point such that this distance is a predefined value, such as a constant, along the curve for each stitch in the plurality of stitches filling the pattern shape regardless of any variation in curvature of the curve defining the pattern shape while the density inset for a given stitch dynamically varies as needed. The process is iteratively repeated, using the constant perpendicular distance from the previous stitch end point to the new stitch end point, until the defined pattern shape is completely filled with the satin-like embroidery stitches. Such satin-like embroidery stitches include both satin stitches and tatami stitches, with a tatami stitch being a variation of a satin stitch.

BRIEF DESCRIPTION OF THE DRAWINGS

FIGS. 10–13 are diagrammatic illustrations of the presently preferred method of the present invention illustrated in FIG. 9 for providing a predefined constant interstitch spacing throughout the defined pattern shape regardless of the variation in curvature of the pattern shape;

FIGS. 14–19 are diagrammatic illustrations of dynamic changes in the density inset in accordance with the presently preferred method of the present invention dependent on the segment shape, stitch length, and stitch angle, with different stitch angles being illustrated for FIGS. 15, 17, and 19; and FIGS. 20–22 are graphical illustrations of an exemplary parametric curve shape for use with the presently preferred method of the present invention, with FIG. 20 graphically illustrating x with respect to t, FIG. 21 graphically illustrating y with respect to t, and FIG. 22 graphically illustrating x and y related together by t to describe a spiral curve.

DETAILED DESCRIPTION OF THE PREFERRED EMBODIMENT

Figure 1:
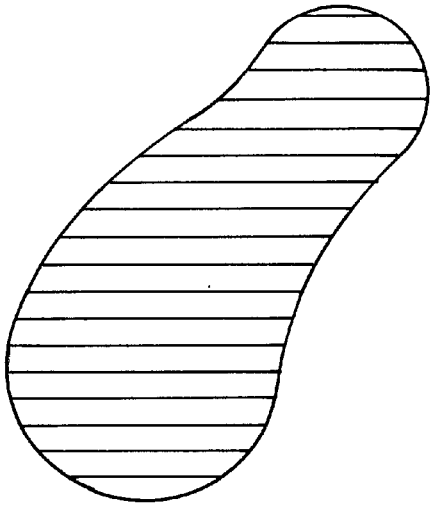
FIG. 1 is a diagrammatic illustration of a typical defined embroidery pattern shape filled with parallel satin-like embroidery stitches.
Figure 2:
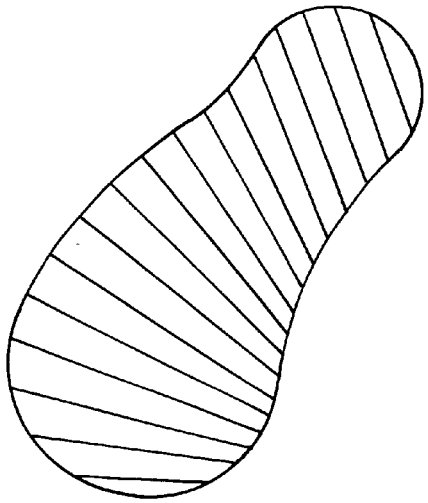
FIG. 2 is a diagrammatic illustration, similar to FIG. 1, of the typical defined embroidery pattern shape of FIG. 1 filled, instead, with turning satin-like embroidery stitches which follow the curvature of the pattern shape.
Figure 3:
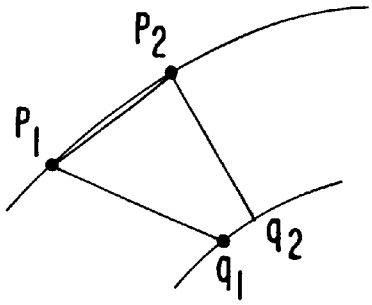
FIG. 3 PRIOR ART
FIGS. 3 and 4 are diagrammatic illustrations of one prior art method of providing turning stitches at a desired interstitch distance.
Figure 4:
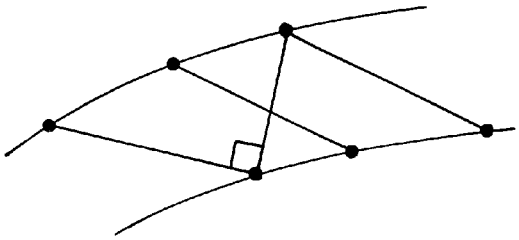
FIG. 4 PRIOR ART
Figure 5:
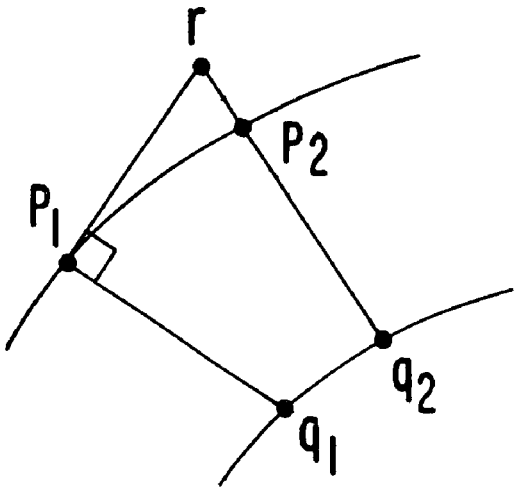
FIG. 5 PRIOR ART
FIGS. 5 and 6 are diagrammatic illustrations of another prior art method of providing turning stitches at a desired interstitch distance.
Figure 6:
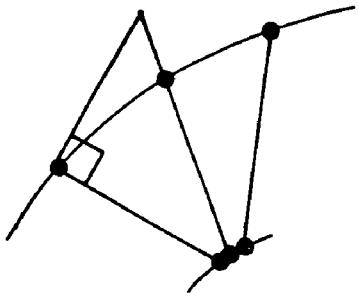
FIG. 6 PRIOR ART
Figure 7:
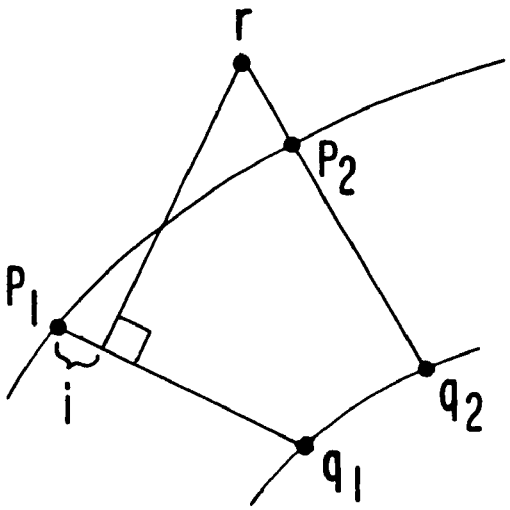
FIG. 7 PRIOR ART
FIGS. 7 and 8 are diagrammatic illustrations of still another prior art method of providing turning stitches at a desired interstitch distance, with this prior art method being an enhancement of the prior art method of FIGS. 5 and 6.
Figure 8:
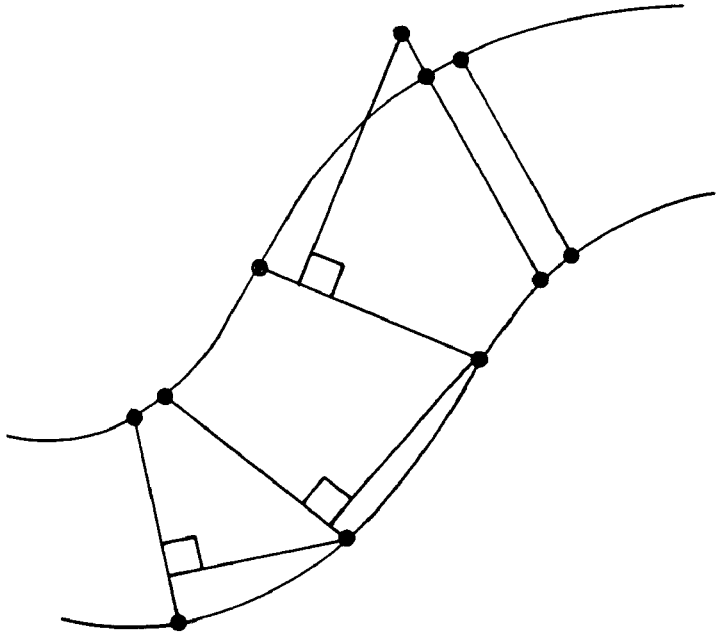
FIG. 8 PRIOR ART
Figure 9:
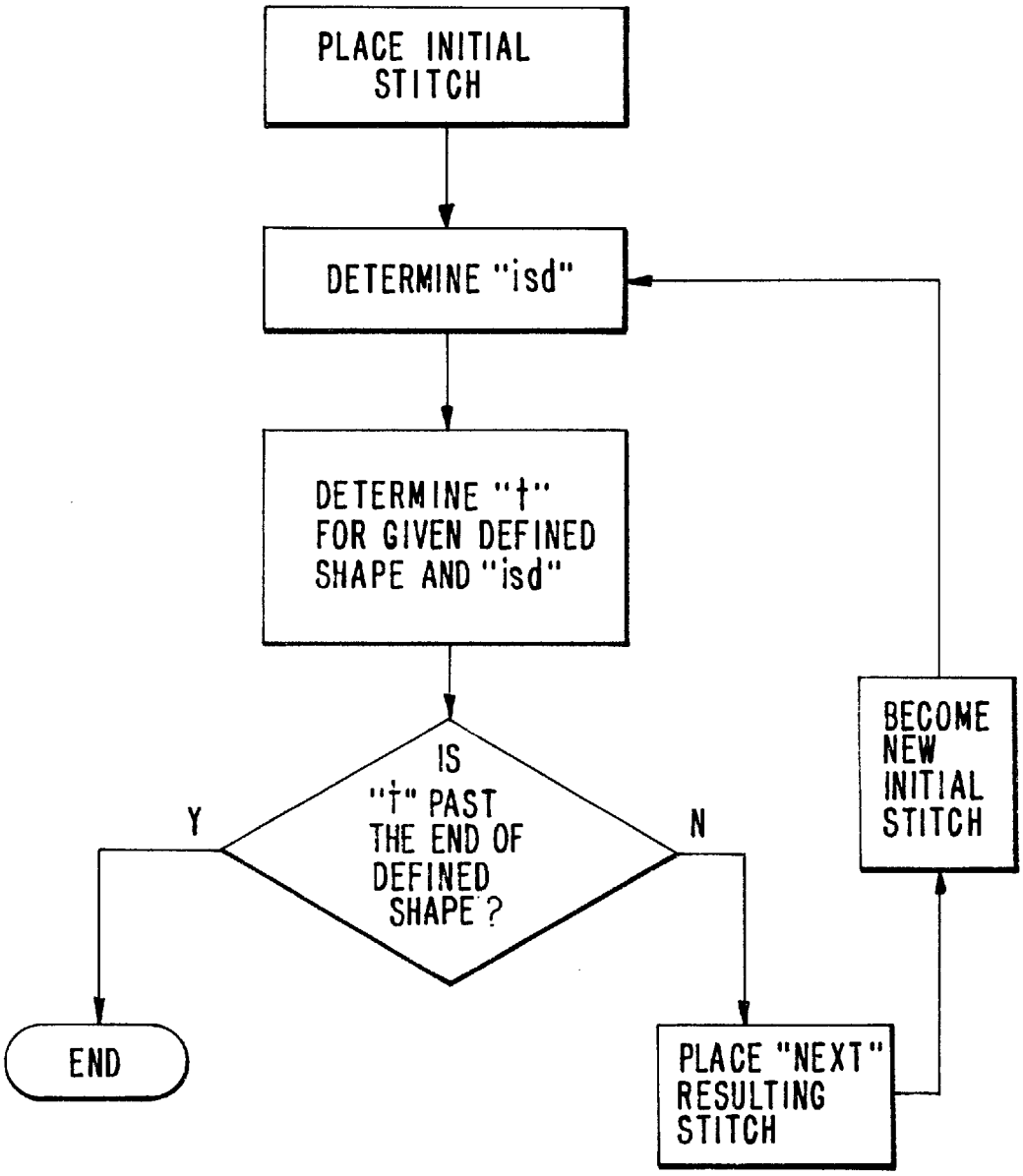
FIG. 9 is a flow diagram of the presently preferred method of the present invention.
Figure 10:
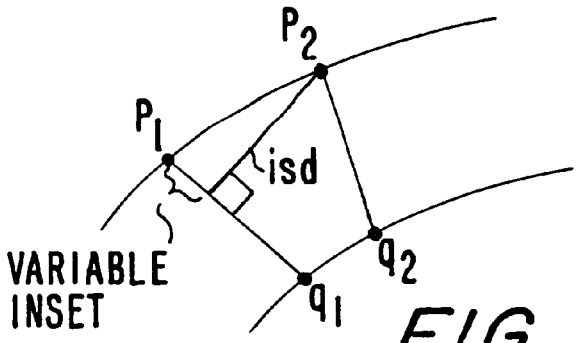

Referring now to the drawings in detail, and particularly to FIGS. 9 through 22, the presently preferred method of the present invention for filling a defined embroidery pattern with turning satin-like stitches while maintaining a predefined interstitch spacing, or isd, regardless of any variation in the curvature of the defined shape shall now be described, with the defined shape being defined, by way of example, by parametric equations, and with the predefined value of the isd being maintained as a constant throughout the pattern shape being filled by way of example. In this regard, as will be explained in greater detail hereinafter, the mathematical curves which define the pattern shape to be filled with the satin-like stitches are parametric equations which specify the location of the next embroidery stitch as a function of a parameter t in accordance with well known mathematics used in computer graphics, such as described in "Computer Graphics, Principles and Practice (Systems Programming), 2nd Edition", by James D. Foley, January, 1996, Addison-Wesley Pulishing Co. ("the Foley reference"), and "An Introduction to Splines for Use in Computer Graphics and Geometric Modeling", by Richard H. Bartels, John C. Beatty, Brian A. Barsky, 1987, Morgan Kaufman Publishing, Inc. ("the Bartels et al reference").

FIGS. 20–22 illustrate the well known concept of parametric equations to define a shape such as for use, by way of example, with the presently preferred method of the present invention. The curved shape illustrated in FIG. 22 is a spiral. Parametric curves are a well known technique for describing complex curves and generally have the form (x,y)=(f(t), g(t)), in which x and y represent actual quantities and t represents an arbitrary quantity whose purpose is to relate x and y. For example, the parametric equation (x,y)=(t cos (t), t sin (t)) is represented by the graphical illustrations of FIGS. 20–22, with FIG. 20 graphically illustrating x with respect to t, FIG. 21 graphically illustrating y with respect to t, and FIG. 22 graphically illustrating x and y related together by t, but with t not shown, to describe the spiral curve in the above example. Such parametric curves are commonly used in computer graphics applications because of this descriptive power. The presently preferred method of the present invention may be used with parametric curves to describe embroidery pattern shapes as well as with more simple curved shapes, with a predefined, such as a constant, interstitch spacing or distance being maintained, in either event, regardless of the variation in curvature of the pattern shape being filled. For purposes of describing the presently preferred method of the present invention, it shall be described, by way of example, using an embroidery pattern shape of the type defined by parametric equations.

The presently preferred method of the present invention may be carried out using a microprocessor controlled embroidery machine using a control program created, by way of example, using an IBM THINK PAD 560, having 32 MB of RAM, and a speed of 133 MHz capable of running WINDOWS 95 or WINDOWS NT, and written in C++. The programming operation to carry out the presently preferred method of the present invention would be readily apparent to a person of ordinary skill in the art given the flow diagram of FIG. 9 and the subsequent description of the presently preferred method with respect to FIGS. 9–19. In this regard, referring now to FIGS. 9 and 10, the presently preferred method of the present invention comprises the steps of placing a satin-like embroidery stitch, termed the initial stitch since it is the starting point for the next stitch location, determining the isd or interstitch distance to the next stitch, determining the parameter t in the applicable parametric equation for the given defined pattern shape and isd, determining whether this parameter t is past the end of the defined pattern shape where, if the answer is yes, the process is ended while, if the answer is no, the resulting new turning stitch or next stitch is then placed with its end point p2 along the defined curve associated with the pattern shape at a predefined interstitch distance or isd, such as a constant, from the end point p1 of the previous stitch, whereupon it becomes the next initial stitch or starting point for the next successive stitch and the process is iteratively repeated for each successive stitch and each corresponding predefined isd associated with the next successive stitch, until all of the satin-like embroidery stitches fill the defined pattern shape. In this regard, although generally the interstitch distance is preferably maintained as a constant throughout the pattern shape, if desired it can be intentionally varied in accordance with the presently preferred method of the present invention by preselecting predefined values for the isd for any given stitch pair. Thus, the predefined value of the isd can be a constant for all stitches or any desired variation as long as the desired value has been predefined before the next successive stitch is to be placed in the pattern shape. Thus, when the satin-like embroidery stitches are generated in accordance with the preferred method of the present invention, the interstitch spacing is maintained at a predefined value which may vary or be a constant throughout the filling of the pattern shape in accordance with the desires of the user.

Figure 12:
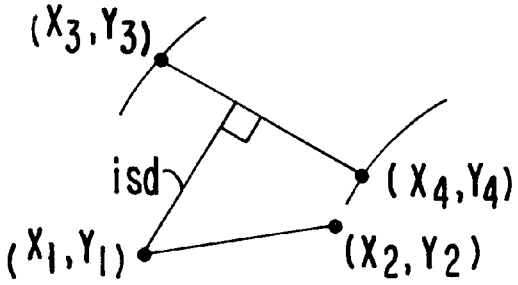

A mathematical model for expressing the interstitch spacing or isd, in accordance with the presently preferred method of the present invention, is as follows: isd=M(x1, y1, x2, y2, x3, y3, x4, y4). This expression quantifies the interstitch spacing of a pair of stitches in accordance with the presently preferred method of the present invention, such as illustrated in FIGS. 12 and 13 by way of example. The first stitch or starting point in this example has end points (x3, y3) and (x4, y4), and the second stitch, which is the next successive stitch, has end points (x1, y1) and (x2, y2). Under this mathematical model, all pairs of stitches which yield the same isd are considered to be the same distance apart. A key aspect of the method of the present invention is the placing of the next stitch at a specified or predefined spacing from a known previous stitch. In order to accomplish this, the computer conventionally analyzes the mathematical curves which describe or define the pattern shape to be filled with the satin-like embroidery stitches. These equations express how the next stitch turns as it moves further away from the previous stitch, with the equations in the above example being parametric equations which specify the location of the next stitch as a function of the parameter t. Thus, these parametric equations can be expressed in the form: (x1, y1, x2, y2)=f(t). Given a value for t, the above parametric equation yields a stitch placement with one end point at (x1, y1) and the other end point at (x2, y2). At a certain value of t, t0, this parametric equation yields a stitch which is identical to the previous stitch and at values of t greater than t0, this parametric equation will yield a stitch that is progressively further away from the previous stitch.

Figure 11:
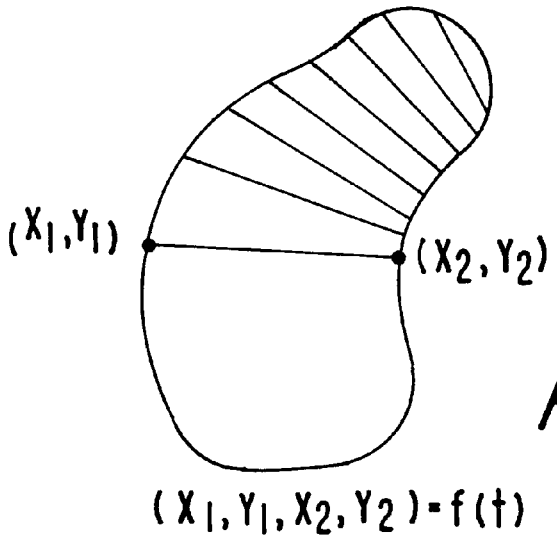

For example, in a turning shape for the defined pattern shape, such as illustrated in FIG. 11, any stitch line is determined by the programmed computer, in the above example, by substituting t into four different cubic polynomials which may be readily derived from well known Bezier curves ,such as described in the aforementioned Foley reference and Bartels et al reference relating to computer graphics. By doing this the above parametric equation becomes (x1, y1, x2, y2)=(fx1(t), fy1(t), fx2(t), fy2(t)), where fx1(t)=at^3+bt^2+ct+d, fy1(t)=et^3 +ft^2+gt+h, fx2(t)=it^3+jt^2 +kt+1, and fy2(t)=mt^3+nt^2+to+p. The computer then introduces the mathematical model for the interstitch spacing expressed above in the equation for isd. Since the previous stitch is known, the location of its end points are substituted as constants for x3, y3, x4, y4 to obtain the simpler parametric equation isd=g(x1, y1, x2, y2) where isd represents the desired interstitch spacing between adjacent stitches, with the foregoing expression representing the interstitch spacing of a stitch (x1, y1, x2, y2) from the known previous stitch, such as illustrated in FIGS. 11–13. For example, one preferred method to model the interstitch spacing in accordance with the presently preferred method of the present invention, given two stitches (x1, y1, x2, y2) and (x3, y3, x4, y4), in the example illustrated in FIG. 12, takes the perpendicular distance between the point (x1, y1) and the line segment from (x3, y3) to (x4, y4), with the expression for this distance, taking x1 and y1 to be the only free variables, having the form isd=sqrt(px1+qy1+r). This expression is arrived at in accordance with the presently preferred method of the present invention by the computer by taking the standard equation for distance between a point and a line segment, expanding, and simplifying with respect to the free variables x1 and y1. In accordance with the presently preferred method, x3, y3, x4, and y4 are taken to be fixed because they are the location of the previous stitch determined in the previous iteration. In order to obtain a relationship between the parameter t and the isd in the above example, the expression isd=g(x1, y1, x2, y2)=g(f(t)) reduces to isd=h(t). Since isd is predefined or known, the above expression may be solved for t by replacing the above complex expressions with simpler approximations of the same form and substituting t into the previous expression f(t)=(x1, y1, x2, y2) to yield the placement of the next stitch (x1, y1, x2, y2). Thus, in accordance with the presently preferred method, in the above example, the computer has calculated the placement of the next stitch in the pattern such that, under the above mathematical model, a predefined constant interstitch distance is maintained between adjacent stitches in the pattern as the pattern shape is filled by the embroidery machine under control of the microprocessor. For example, the above expressions can be composed by the computer, in accordance with the presently preferred method, to get the expression isd=sqrt(p*fx1(t)+q*fy1(t)+r) or isd^2=pat^3+pbt^2+pct+pd+qet^3+qft^2+qgt+qh+r. Simplifying the above expression with respect to the free variable t, and taking the predefined isd to be fixed based on the predefined target interstitch spacing, the above expression becomes isd^2+(pa+qe)t^3+(pb+qf)t^2+(pc+qg)t+(pd+qh+r). The computer then solves this cubic equation directly for t using well known mathematics. By way of example, FIG. 13 illustrates applying the isd constraint to the turning of the stitch as governed by f(t) as per the expression f(t)=(x1, y1, x2, y2) in order to solve for t.

As an alternative, if it is desired to avoid solving cubic equations, in accordance with the presently preferred method of the present invention, the cubics fx1(t) and fy1(t) may be approximated by the computer with lower order expressions and the resulting equation simplified to a quadratic equation of the form isd^2=quadratic(t) or a linear equation of the form isd^2=mt+b, and solved for t. The resulting solution is the value t such that the turning stitch (x1, y1, x2, y2)=f(t) is the correct interstitch spacing isd from the known previous stitch (x3, y3, x4, y4) according to the preferred mathematical model for spacing which has been selected, and the next stitch is thereby placed at the predefined desired spacing from the previous stitch by the microprocessor controlled embroidery machine.

It should be noted in the notation in the above mathematical expressions, AB, where A and B are single letter variables, and A*B where A or B are multiletter variables, means A times B, (expression)B means the expression in parentheses times B, A^B means A to the power B, and f(t) means a function that takes a parameter t in which f may include fixed constants such as in the expression f(x)=mx+b in which m and b are fixed.

Referring now to FIGS. 14–19, illustrations are shown of how the density inset automatically dynamically varies in accordance with the presently preferred method of the present invention depending on the pattern segment shape, stitch length, and stitch angle. As will be noted, in accordance with the presently preferred method of the present invention, the density inset is automatically adjusted by the computer at each stitch to provide a correct density calculation at the outside of the turn, accounting for the length of the stitch and the angle of the stitching, with the end point of the new stitch being brought in the appropriate inset distance from the previous stitch. As shown by way of example in FIGS. 14–15, assume L1=0.4 mm and L2=0.8 mm, the stitch length is 0.4 mm. Assuming a stitch angle A of 30 degrees, based on the shape, stitch length and stitch angle, the computer would automatically adjust the density inset i to 26.8% with the density d, or distance between stitches being 0.4 mm. FIGS. 16–17 illustrate what happens when the density d remains at 0.4 mm but the stitch length (L2–L1) changes to 0.28 mm and the stitch angle B changes to 45 degrees. In this instance, the density inset i is automatically adjusted to 58.6%. Finally, FIGS. 18–19 illustrate what happens when the density d still remains at 0.4 mm but the stitch length (L2–L1) changes to 0.23 mm and the stitch angle C changes to 60 degrees. In this instance, the density inset d is automatically adjusted to 100%. Thus, in all of the above examples, the density remains constant throughout as the density inset changes dynamically to adjust for various stitch lengths and stitch angeles as the shape of the pattern changes.

Summarizing the presently preferred method of the present invention, the density inset for the next adjacent satin-like embroidery stitch, whether a stain stitch or a tatami stitch, is dynamically varied in accordance with any change in the defined pattern shape from the previous stitch, taking into account the stitch length and stitch angle. The associated end points of the next stitch are brought within an appropriate density inset distance from the previous adjacent stitch for maintaining a predefined interstitch spacing, which may be a constant or controllably vary as desired, by creating an initial or starting stitch having an associated end point along the curve defining the pattern shape and then creating a next stitch having an associated end point along the curve which is a perpendicular distance from the previous stitch end point such that this distance is a predefined value, such as a constant, along the curve for each stitch pair in the plurality of stitches filling the pattern shape. The process is iteratively repeated, using the predefined perpendicular distance from the previous stitch end point to the new stitch end point until the defined shape is completely filled, regardless of the variability in curvature of the defined shape.

What is claimed is:

1. A method of filling a defined embroidery pattern shape comprising a curve defining said shape with a plurality of turning satin-like embroidery stitches which turn to follow said defined shape as said shape is filled with said satin-like embroidery stitches, said defined shape having an interstitch spacing between adjacent satin-like embroidery stitches in said filled embroidery pattern shape, said method comprising the step of maintaining a predefined interstitch spacing between said adjacent turning satin-like embroidery stitches as said defined shape is filled with said satin-like embroidery stitches, each of said satin-like embroidery stitches having an associated density inset, said step of maintaining said predefined interstitch spacing comprising the step of dynamically varying said density inset for the next adjacent satin-like embroidery stitch in accordance with any change in said defined shape from the previous satin-like embroidery stitch.

2. A method in accordance with claim 1 further comprising the step of dynamically varying said next stitch density inset in accordance with the stitch length and stitch angle of said satin-like embroidery stitch.

3. A method in accordance with claim 2 further comprising the step of maintaining a constant stitch density for said plurality of satin-like embroidery stitches within said defined shape.

4. A method in accordance with claim 1 further comprising the step of maintaining a constant stitch density for said plurality of satin-like embroidery stitches within said defined shape.

5. A method in accordance with claim 4 further comprising the step of dynamically varying said density inset for each stitch comprising said defined shape for providing a density determination at the outside of any turns in said defined shape.

6. A method in accordance with claim 5 wherein adjacent satin-like embroidery stitches within said defined shape have associated end points, said method further comprising the step of bringing the associated end points of the next stitch within an appropriate density inset distance from the previous adjacent satin-like embroidery stitch for maintaining said predefined interstitch spacing.

7. A method in accordance with claim 1 wherein each satin-like embroidery stitch has an associated density inset and said defined shape has an associated stitch density, said method further comprising the step of dynamically varying said density inset for each stitch comprising said defined shape for providing a density determination at the outside of any turns in said defined shape.

8. A method in accordance with claim 7 wherein adjacent satin-like embroidery stitches within said defined shape have associated end points, said method further comprising the step of bringing the associated end points of the next stitch within an appropriate density inset distance from the previous adjacent satin-like embroidery stitch for maintaining said predefined interstitch spacing.

9. A method in accordance with claim 1 wherein each satin-like embroidery stitch has an associated end point, said method further comprising the step of dynamically varying said density inset for each new satin-like embroidery stitch based on the previous adjacent satin-like embroidery stitch and any change in said defined shape between associated end point of said new satin-like embroidery stitch and said associated end point of said previous adjacent satin-like embroidery stitch as said defined shape is filled with said plurality of satin-like embroidery stitches.

10. A method in accordance with claim 9 further comprising the step of dynamically varying said density inset for each of said satin-like embroidery stitches within said defined shape until all of said plurality of satin-like embroidery stitches fill said defined shape.

11. A method in accordance with claim 10 wherein said defined shape has a variability in curvature, said method further comprising the step of dynamically varying said density inset regardless of said variability in curvature of said defined shape.

12. A method in accordance with claim 1 wherein said defined shape has a variability in curvature, said method further comprising the step of dynamically varying said density inset regardless of said variability in curvature of said defined shape.

13. A method in accordance with claim 12 further comprising the step of dynamically varying said next stitch density inset in accordance with the stitch length and stitch angle of said satin-like embroidery stitch.

14. A method in accordance with claim 13 further comprising the step of maintaining a constant stitch density for said plurality of satin-like embroidery stitches within said defined shape.

15. A method in accordance with claim 12 further comprising the step of maintaining a constant stitch density for said plurality of satin-like embroidery stitches within said defined shape.

16. A method in accordance with claim 1 wherein said predefined interstitch spacing is a constant throughout the pattern shape being filled.

17. A method of filling a defined embroidery pattern shape comprising a curve defining said shape with a plurality of turning satin-like embroidery stitches which turn to follow said defined shape as said shape is filled with said satin-like embroidery stitches, said defined shape having an interstitch spacing between adjacent satin-like embroidery stitches in said filled embroidery pattern shape, said method comprising the steps of creating a first satin-like embroidery stitch in said plurality of stitches having an associated end point disposed a perpendicular distance from a line passing through said first stitch end point to said next stitch end point along the curve defining said embroidery pattern shape such that said perpendicular distance is a predefined value along said curve defining said embroidery pattern shape for each subsequent satin-like embroidery stitch comprising said plurality of satin-like embroidery stitches.

18. A method in accordance with claim 17 further comprising the step of creating said next adjacent satin-like embroidery stitch for each satin-like embroidery stitch in said plurality of satin-like embroidery stitches until all of said plurality of satin-like embroidery stitches fill said defined shape, said first stitch comprising an immediately previously created satin-like embroidery stitch.

19. A method in accordance with claim 18 further comprising the step of maintaining a constant stitch density for said plurality of satin-like embroidery stitches within said defined shape.

20. A method in accordance with claim 19 further comprising the step of creating said next adjacent satin-like embroidery stitch regardless of any variation in curvature of said curve defining said pattern shape.

21. A method in accordance with claim 17 further comprising the step of maintaining a constant stitch density for said plurality of satin-like embroidery stitches within said defined shape.

22. A method in accordance with claim 21 further comprising the step of creating said next adjacent satin-like embroidery stitch regardless of any variation in curvature of said curve defining said pattern shape.

23. A method in accordance with claim 17 further comprising the step of creating said next adjacent satin-like embroidery stitch regardless of any variation in curvature of said curve defining said pattern shape.

24. A method in accordance with claim 17 wherein said predefined value of said perpendicular distance is a constant along said curve defining said embroidery pattern shape.

* * * * *